United States Patent [19]

Heikinheimo

[11] 4,281,695

[45] Aug. 4, 1981

[54] METHOD AND SYSTEM OF ALIGNING LUMBER, ESPECIALLY BLOCKS FROM WHICH THE FIRST PAIR OF CANTS HAS BEEN REMOVED

[75] Inventor: Olli Heikinheimo, Helsinki, Finland

[73] Assignee: Plan-Shell Oy, Helsinki, Finland

[21] Appl. No.: 960,180

[22] Filed: Nov. 13, 1978

[51] Int. Cl.[3] ..... B27B 1/00

[52] U.S. Cl. ..... 144/312; 83/367; 144/242 R; 144/245 A; 144/246 C

[58] Field of Search ..... 83/360, 367; 198/456, 198/457; 144/2 R, 242 R, 242 C, 242 D, 246 R, 246 C, 246 E, 312, 326 R, 245 R, 245 A

[56] References Cited

U.S. PATENT DOCUMENTS

| | | | |
|---|---|---|---|
| 2,625,185 | 1/1953 | Merry | 144/246 C |
| 3,068,918 | 12/1962 | Smith | 144/246 C |
| 3,513,321 | 5/1970 | Sherman | 144/312 |
| 3,890,509 | 6/1975 | Maxey | 144/312 |
| 3,941,019 | 3/1976 | Baldwin et al. | 144/312 |
| 3,970,128 | 7/1976 | Kohlberg | 144/312 |
| 3,983,403 | 9/1976 | Dahlstrom et al. | 144/312 |
| 4,023,605 | 5/1977 | Hellstrom et al. | 144/312 |
| 4,086,496 | 4/1978 | Berry | 144/312 |
| 4,127,044 | 11/1978 | Kenyon | 144/312 |
| 4,149,089 | 4/1979 | Idelsohn et al. | 144/312 |

FOREIGN PATENT DOCUMENTS

| | | | |
|---|---|---|---|
| 34951 | 6/1913 | Sweden | 144/246 C |

*Primary Examiner*—W. D. Bray

*Attorney, Agent, or Firm*—McAulay, Fields, Fisher, Goldstein & Nissen

[57] ABSTRACT

A method of aligning lumber from which a first pair of cants has been removed to provide blocks for feeding along a sawing line before they are fed in the sawing line. The block is charged in a longitudinal direction to pass by the control device. The control device defines the block's side profile and outlines the even or sawed surface, after which the block falls on its side and is charged transversely against at least two adjustable stops, which have been positioned in a desired manner so as to ascertain an optimum amount of wood products at the next processing stage. The block always falls with the same side up so that the edge which was the upper edge while measuring the block's profile, is transferred transversely against the adjustable stops.

5 Claims, 2 Drawing Figures

METHOD AND SYSTEM OF ALIGNING LUMBER, ESPECIALLY BLOCKS FROM WHICH THE FIRST PAIR OF CANTS HAS BEEN REMOVED

BACKGROUND OF THE INVENTION

This invention relates to a method of aligning lumber. More particularly, the invention is concerned with the alignment of blocks in which a first pair of cants has been removed.

The lumber is usually obtained in a rough form, as logs, and a first pair of cants is removed from the logs to provide blocks which are to be fed to a saw mill.

The alignment and positioning of the block with respect to the sawing line has an important effect on the amount of full-edged lumber produced from each block. Nowadays the alignment of the block is in practice generally done by hand, based on a visual inspection or an eye-sight calculation only. While using this method, it is very difficult to achieve an optimal result. On the other hand, alignment of the board by hand is a relatively slow process, and it is therefore not suitable for saw mills with a large capacity.

Accordingly, it is an object of this invention to provide a method and a system for rapidly aligning those blocks formed from logs from which the first pair of cants has been removed.

A more specific object of the invention is to align the aforesaid blocks with optimum accuracy without touching the individual blocks with hands.

A further object of the invention is to align lumber, particularly logs or blocks from which the first pair of cants has been removed, in a saw mill before feeding the blocks in alignment with a sawing line in which the block sides are unscrambled and/or the block is divided into cants.

To these ends, the invention consists in the provision of a method of aligning lumber which is made from blocks from which a first pair of cants has been removed to provide for cant-removed blocks hereinafter referred to as blocks for feeding along a sawing line, which comprises charging the (cant-removed) block in a longitudinal direction to pass by a control device, which control device defines the block's side profile and outlines the even sawed surface; after which the block is permitted to fall on its side, and then after the block has fallen on its side, the block is transversely charged against at least two adjustable stops which are positioned in a desired manner according to the above-mentioned information so as to ascertain an optimum amount of wood products at a next processing stage in accordance with the information obtained from the control device.

As a further feature, the block always falls with the same side up, so that the edge which was the upper edge while measuring the block's profile is then transferred against the adjustable stops. The block is passed through a pair of prop rollers situated symmetrically on both sides of the block, and these prop rollers have an inclined surface, with one of the pair of rollers forcing the blocks to fall in the same direction each time.

Accordingly, the blocks will always fall in the same direction. Therefore, the blocks is so controlled that it will and can fall only in one and the same direction.

Other objects, advantages and the nature of the invention will become readily apparent from the detailed description of the invention described in connection with the drawing.

DETAILED DESCRIPTION OF THE PREFERRED EMBODIMENT

Figure 1:
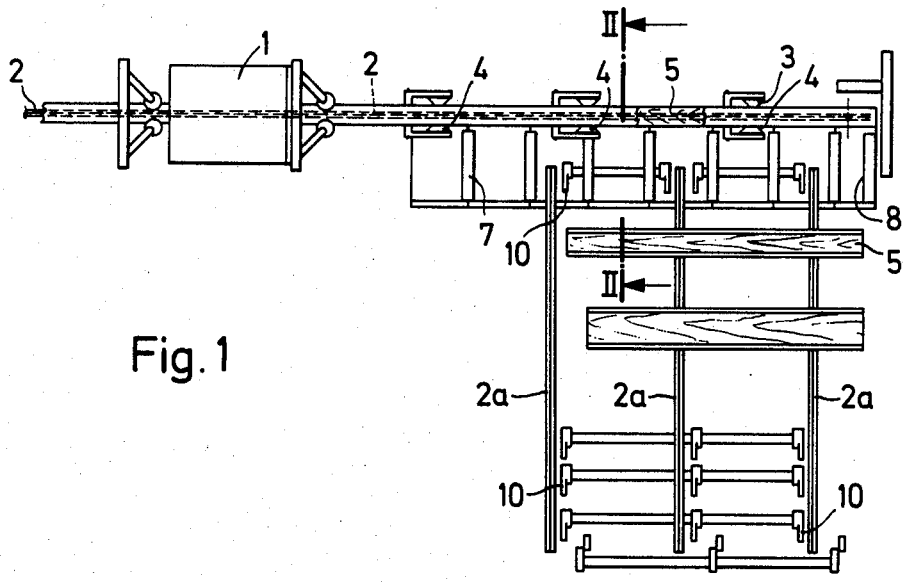
FIG. 1 is a schematic view of an apparatus used in carrying out the method and system, and contstructed according to the invention, as seen from the top; and, FIG. 2 is an elevational view of the apparatus of FIG. 1 on a larger scale, partially in section taken on line II—II of FIG. 1.

Referring now more particularly to the drawing, and in particular to FIG. 1 which shows a schematic view of the apparatus on which the method is carried out. The apparatus comprises a control device 1 which defines the side profile of the traversing block. The control device 1 also measures and announces or makes known the area of the sawed surface. Thereafter the block is always turned with the same side up. In FIG. 1, the block is turned downwards compared to its previous position. Then the block is transferred in a transverse direction against the adjustable stops 10.

Figure 2:
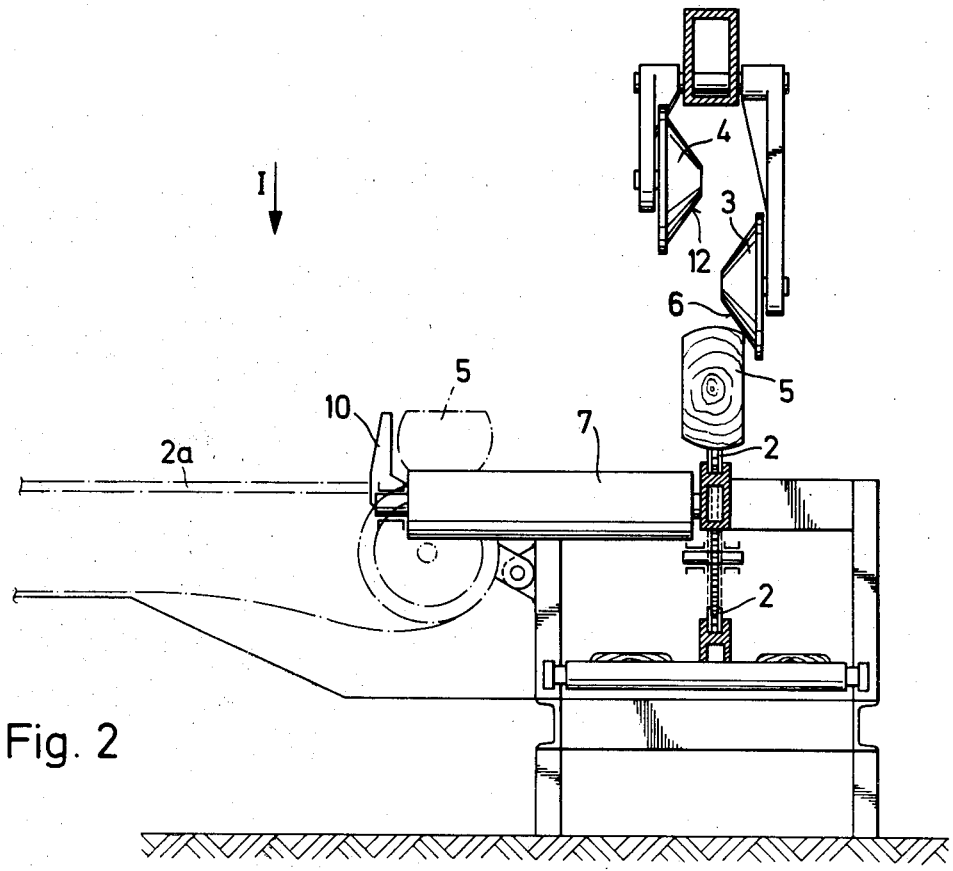

Referring now also to FIG. 2 which is an enlarged front sectional view of the apparatus of FIG. 1, the block 5 is supported laterally by the chain 2 in a horizontal position and is maintained in a vertical position by prop rollers 3 and 4, as the block 5 is moved by the chain 2. Prop rollers 3 and 4 are each provided with an inclined surface 6 and 12, respectively. The block 5 is moved past infeed rollers 7 towards stationary stop 8.

As noted, while the block 5 moves in its vertical position through the control device supported by the chain 2, it is being supported laterally by the prop rollers 3 and 4. The prop rollers 3 and 4 are situated symmetrically on both sides of the block as long as the block passes through the control device. Thereafter, the rollers on one side 4 are lifted up as best seen in FIG. 2, and rollers 3 on the other side are clamped downwards. Thus, the inclined surface 6 of the rollers 3 forces the block always to fall in the same direction. The block falls on the infeed rollers 7, which convey the block's end to enter into contact with the stationary stop 8.

After the block has passed through the control device 1 in a longitudinal direction, a data processing unit calculates its optimal direction and position with respect to a sawing line. For this purpose, the control device has to define the sawed surface area and position of the block. In order to make alignment possible, the control device also has to register the height of the block's upper edge at least at those points that are situated against the stops. Using the information collected by the control device, the data processing unit calculates such position to be adopted by the stops, that when the block moves against these stops, it automatically receives an optimal alignment with respect to the sawing line.

Thereafter, the block is lifted, maintaining its direction, to a saw infeed transfer which conveys the block further to be sawed.

The present invention has been explained with reference to one example only. However, the purpose of the invention is by no means to cover only the aforementioned example, but the practical realizations of the invention can vary, even to a great extent. Thus for example the adjustable stops can be placed directly in the sawing line, when separate transfer of the block from alignment position into the sawing line becomes unnecessary.

While there has been shown what is considered to be the preferred embodiments of the invention and the best mode presently contemplated for carrying out the invention, various changes and modifications may be made therein without departing from the scope of the invention.

I claim:

1. A method of aligning lumber from which a first pair of cants has been removed to provide blocks for feeding along a sawing line, said blocks having a base, sides and a top, comprising:

using a control device having information to define a side profile of a block to examine the blocks which traverse thereby to calculate and to determine the optimal direction and position of the blocks with respect to the sawing line;

moving each of the individual blocks on its base in a longitudinal direction to pass by the control device to permit the control device to produce an output characteristic for defining each of the individual block's side profile and outlining the even sawed surface;

causing one of the individual blocks to fall on its side;

providing at least two adjustable stops and adjusting the stops relative to the individual blocks side profile in response to the output characteristics of the block provided by the control device; and, transversely moving the block after it has fallen on its side against the at least two adjustable stops, the adjustable stops being positioned in a desired manner in response to information contained in the output characteristic so as to ascertain an optimum amount of wood products at a next processing stage in accordance with information obtained by the control device from the block.

2. The method of claim 1, including:

controlling each individual block so that it always falls in the same direction with the same side up; and, transferring the fallen block transversely against the adjustable stops so that the edge which was the upper edge while measuring the blocks profile is transferred against the adjustable stops.

3. The method as claimed in claim 1 or 2, including passing the block through a pair of prop rollers situated symmetrically on both sides of the block.

4. The method as claimed in claim 1 or 2, including passing each of the blocks individually through a pair of prop rollers having an inclined surface, the inclined surface of one of said pair of rollers forcing each of the blocks to fall in one and the same direction.

5. The method as claimed in claim 1 or 2, including transferring each of the blocks to the adjustable stops with the edge which was the upper edge when moved past the control device against the adjustable stops.

* * * * *

UNITED STATES PATENT AND TRADEMARK OFFICE

CERTIFICATE OF CORRECTION

PATENT NO. : 4,281,695

DATED : August 4, 1981

INVENTOR(S) : Olli Heikinheimo et al

It is certified that error appears in the above—identified patent and that said Letters Patent is hereby corrected as shown below:

On the Title Page,

Item Number (73) Assignee should read --Plan- Sell Oy--

Column 1, line 65 change "blocks" to --block--

Signed and Sealed this

Sixteenth Day of March 1982

[SEAL]

Attest:

GERALD J. MOSSINGHOFF

Attesting Officer

Commissioner of Patents and Trademarks